United States Patent [19]

Tanei et al.

[11] 4,105,449

[45] Aug. 8, 1978

[54] EXTRUDED ELECTROPHOTOGRAPHIC RECORDING MATERIAL

[75] Inventors: Tadayoshi Tanei, Nagaokakyo; Shigeki Nakamura; Masahiro Hotta, both of Osaka, all of Japan

[73] Assignee: Sekisui Kagaku Kogyo Kabushiki Kaisha, Japan

[21] Appl. No.: 808,776

[22] Filed: Jun. 21, 1977

Related U.S. Application Data

[63] Continuation-in-part of Ser. No. 450,241, Mar. 11, 1974, abandoned.

[30] Foreign Application Priority Data

Aug. 17, 1973 [JP] Japan ..... 48/92682

[51] Int. Cl.[2] ..... G03G 5/087

[52] U.S. Cl. ..... 96/1.8; 96/1.5 R; 96/1.7; 96/1 R; 427/35; 427/36; 250/315 A; 264/211

[58] Field of Search ..... 96/1.5, 1.6, 1.7, 1.8 R; 427/35, 36; 250/315 R, 315 A; 264/211

[56] References Cited

U.S. PATENT DOCUMENTS

| | | | |
|---|---|---|---|
| 2,795,821 | 6/1957 | Williams | 264/211 |
| 3,085,051 | 4/1963 | Hamm et al. | 96/1.8 X |
| 3,197,307 | 7/1965 | Blake et al. | 96/1.8 |
| 3,251,686 | 5/1966 | Gundlach | 96/1.5 |
| 3,406,063 | 10/1968 | Matkan et al. | 96/1.5 |
| 3,434,832 | 3/1969 | Joseph et al. | 96/1.5 |
| 3,501,330 | 3/1970 | Cassiers et al. | 96/1.5 X |
| 3,512,969 | 5/1970 | Robillard | 96/1 R X |
| 3,558,762 | 1/1971 | Kochulein et al. | 264/211 X |
| 3,624,186 | 11/1971 | Kubota | 264/211 X |
| 3,674,477 | 7/1972 | Carlson | 96/1.5 X |
| 3,694,402 | 9/1972 | Essam | 264/211 X |
| 3,775,103 | 11/1973 | Sadamatsu et al. | 96/1 R |
| 3,791,826 | 2/1974 | Cherry et al. | 96/1.5 |

FOREIGN PATENT DOCUMENTS

| | | | |
|---|---|---|---|
| 702,102 | 1/1965 | Canada | 96/1.5 |
| 2,100,696 | 7/1971 | Fed. Rep. of Germany | 96/1.8 |
| 2,154,146 | 5/1972 | Fed. Rep. of Germany | 96/1 R |
| 4,630,033 | 1/1971 | Japan | 96/1.8 |
| 3,817,246 | 9/1963 | Japan | 96/1 R |
| 1,061,085 | 3/1967 | United Kingdom | 96/1.7 |

*Primary Examiner*—Roland E. Martin, Jr.
*Attorney, Agent, or Firm*—Wenderoth, Lind & Ponack

[57] ABSTRACT

An electrophotographic recording material formed by extrusion, which comprises (A) 100 parts by weight of a blended composition of olefins having high and low melt indices in a specified weight ratio, (B) 0.025 to 40 parts by weight of a specified light-sensitizing organic compound, (C) 200 to 600 parts by weight of particulate photoconductive zinc oxide, (D) 0.06 to 0.4 part by weight, per 100 parts by weight of the total of components (A), (B) and (C), of a specified metal (e.g., Mg, Ca, Zn, Sn) salt of a $C_{12-20}$ saturated or unsaturated fatty acid, and (E) 1 to 20 parts by weight of a silicone polymer; the components (B), (C), (D) and (E) being uniformly dispersed in component (A), and the light-sensitizing organic compound (B) being adsorbed to the surface of the zinc oxide (C).

10 Claims, 2 Drawing Figures

EXTRUDED ELECTROPHOTOGRAPHIC RECORDING MATERIAL

Figure 1:
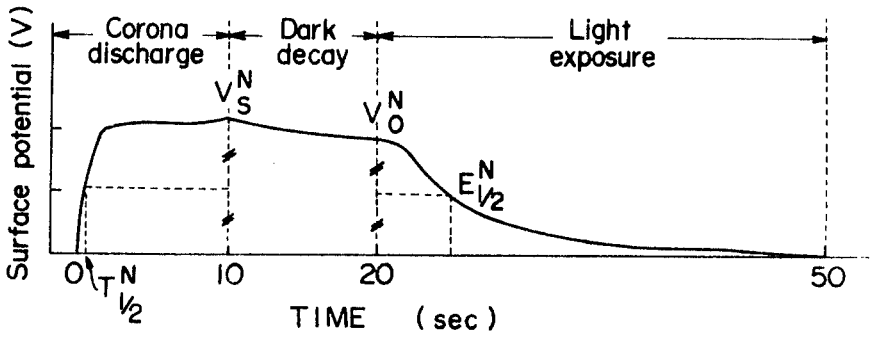

This is a continuation-in-part application of Application Ser. No. 450,241 filed Mar. 11, 1974, now abandoned.

This invention relates to an electrophotographic recording material, and more specifically to a new electrophotographic recording material formed by extrusion.

One conventional method for electrophotographic recording comprises charging the surface of an electrophotographic recording material, projecting a light image to the charged surface to form a latent image, applying a toner to the latent image area to develop it, and fixing the image directly or after transferring it to a separate sheet. An example of the electrophotographic recording material is disclosed in U.S. Pat. No. 3,501,330 to P. M. Cassiers et al. The recording material disclosed in this patent is obtained by wetting a thermoplastic resin such as a polyethylene resin or polyester resin with a solvent, adding a zinc oxide powder and a lubricant, optionally adding additives for sensitization, and extruding the mixture at a fusible temperature range onto a support through a slit-like orifice. As is clearly seen from the structure of the extruder used in this patent, the extruding pressure is low, and in order to permit extrusion from the slit-like orifice, the mixture should be a molten mixture having a low viscosity. Thus, the thermoplastic resin used is one which has a low viscosity when molten. The electrophotographic recording material obtained in this patent has very low mechanical strength and may undergo cracking upon the application of an external force. Furthermore, it has low abrasion resistance and poor flexibility. In addition, the photoconductive substance does not disperse uniformly, and feasible electrophotographic recording characteristics are difficult to obtain. Another disadvantage is that zinc stearate as a lubricant must be used in great quantities in order to have it exhibit a lubricating action, but the use of too much lubricant will deteriorate the electrophotographic recording characteristics. Moreover, the electrophotographic recording material of this patent cannot withstand use for long periods of time because its electrophotographic recording characteristics are deteriorated extremely by humidity and moisture.

It is an object of this invention to provide an electrophotographic recording material which is free from these defects.

Another object of this invention is to provide an electrophotographic recording material which has superior mechanical strength and does not undergo cracking by an external force even when used singly, and which has superior electrophotographic recording characteristics that will not be deteriorated by the action of humidity and moisture.

Other objects and advantages of this invention will become apparent from the following detailed description.

According to this invention, there is provided an electrophotographic recording material formed by extrusion, which comprises (A) a blended olefin resin composition consisting essentially of (a) an olefin resin having a melt index of 0.1 to 20 g/10 minutes, and (b) an olefin resin having a melt index of 30 to 300 g/10 minutes, the weight ratio of olefin resin (a) to olefin resin (b) ranging from 5:95 to 95:5, (B) 0.025 to 40 parts by weight, per 100 parts by weight of the blended olefin resin composition (A), of at least one light-sensitizing organic compound selected from the group consisting of organic dye compounds, electron-accepting organic compounds and electron-donating organic compounds, (C) 200 to 600 parts by weight, per 100 parts by weight of the blended olefin resin composition (A), of particulate photoconductive zinc oxide having an average particle diameter of 0.1 to 5 microns, (D) 0.06 to 0.4 part by weight, per 100 parts by weight of the total of the components (A), (B) and (C), of a salt formed between a saturated or unsaturated fatty acid containing 12 to 20 carbon atoms and a metal of Group IIa, IIb or IVb (except radium) of the periodic table, and (E) 1 to 20 parts by weight, per 100 parts by weight of the blended olefin resin composition (A), of a silicone polymer, the components (B), (C), (D) and (E) being uniformly dispersed in the component (A), and the light-sensitizing organic compound (B) being adsorbed onto the surface of the particulate photoconductive zinc oxide (C).

This new electrophotographic material is described in more detail below.

The blended olefin resin composition (A) which forms the matrix of the recording material of this invention is characterized by consisting essentially of (a) an olefin resin having a melt index of 0.1 to 20 g/10 minutes, preferably 0.15 to 10 g/10 minutes and (b) an olefin resin having a melt index of 30 to 300 g/10 minutes, preferably 50 to 250 g/10 minutes.

The olefin resin (a) having a melt index of 0.1 to 20 g/10 minutes imparts mechanical strengths such as tensile strength and tear strength to the electrophotographic recording material, and serves to impart sheet-forming ability to the material when the constituents of the recording material, especially the particulate photoconductive zinc oxide (C), are incorporated in it in great quantities. On the other hand, the olefin resin (b) having a melt index of 30 to 300 g/10 minutes prevents the formation of micropores in the preparation of the electrophotographic recording material by extrusion.

In the preparation of electrophotographic recording materials by extrusion, fine pores frequently occur owing to stretching, and tend to deteriorate the electrophotographic recording characteristics of the recording material obtained. This can be effectively prevented by the olefin resin (b) having a melt index of 30 to 300 g/10 minutes.

The "melt index", as used in the present application, is a value measured in accordance with ASTM D-1238.

The weight ratio of the olefin resin (a) to the olefin resin (b) is 5:95 to 95:5, preferably 10:90 to 70:30. It has been found that the use of the olefin resins (a) and (b) within the range of these ratios can impart mechanical strengths to the recording material and effectively prevent the occurrence of minute pores during extrusion.

Examples of suitable olefin resins (a) or (b) are a homopolymer of ethylene, copolymers of ethylene with other copolymerizable monomers (e.g., vinyl acetate, vinyl chloride, styrene, propylene, alkyl acrylates, acrylamide, aluminum acrylate, magnesium acrylate), a homopolymer of propylene, copolymers of propylene with other copolymerizable monomers (e.g., vinyl acetate, ethylene, dicyclopentadiene, vinyl alcohol, 1,4-hexadiene), a homopolymer or copolymer of butene. The olefin resins (a) and (b) may be of the same or different kinds.

The powder of the photoconductive zinc oxide (C) used in this invention is a semiconductor substance which when exposed to light, causes an increase in electric conductivity by adsorption of photon from incident light. The particulate photoconductive zinc oxide can be used in an amount of 200 to 600 parts by weight, preferably 350 to 550 parts by weight, per 100 parts by weight of the blended olefin resin composition (A). The photoconductive zinc oxide is used in powdery or granular form, and suitably has an average particle diameter of 0.1 to 5 microns, especially 0.2 to 1 micron. When the photoconductive zinc oxide has a particle diameter within this range, the resulting recording material can be electrically charged in a uniform manner.

In addition to the ingredients described above, at least one light-sensitizing organic compound (B) selected from the group consisting of organic dye compounds, electron-accepting organic compounds, and electron-donating organic compounds is used. The amount of the light-sensitizing organic compound (B) is 0.025 to 40 parts by weight, preferably 0.25 to 10 parts by weight, per 100 parts by weight of the blended resin composition (A). By using the light-sensitizing organic compound (B) in the amounts specified above, the electrophotographic recording material has improved resistance to repeated use for recording images. Thus, the number of copies that can be obtained from a single recording material can be increased greatly, and the sensitivity of the recording material increases very much.

The organic dye compounds may be any substance which has the property of increasing the conductivity of the photoconductive zinc oxide (C) on the interface between it and the photoconductive zinc oxide (C) upon absorption of visible light rays. Suitable organic dye compounds include, for example, acid dyes such as Rose Bengal, Rhloxin, Erythrosin B, Eosine, Uramine or basic dyes such as Rhodamine B, Methylene Blue, Acridine Orange, Fuchsin, or Crystal Violet. They are used either singly or in combination of two or more. There can also be used reactive dyes such as SUMISIX Brilliant Blue EB (product of Sumitomo Chemical Co., Ltd.), CIBACHRON Brilliant Red 2G-P (C. I. Reactive Red 15), PROCION Brilliant Red H-8P (C. I. Reactive Red 31) and LEVASIX Brilliant Red E-4B (C. I. Reactive Red 41), or direct dyes such as Direct Fast Orange S (C. I. Direct Orange 26), SUMILIGHT Red 4B (C. I. Direct Red 81) and Nippon Resin Fast Scarlet 4BA (C. I. Direct Red 230).

The electron-accepting organic compounds that can be used may be any compound which has the property of increasing the conductivity of the photoconductive zinc oxide (C) by accepting electrons on the interface between it and the zinc oxide (C). Suitable electron-accepting organic compounds are compounds containing aromatic rings, which include, for example, maleic acid, maleic anhydride, fumaric acid, phthalic acid, phthalic anhydride, isophthalic acid, terephthalic acid, hemimellitic acid, hemimellitic anhydride, trimellitic acid, trimellitic anhydride, glycolic acid, methoxyacetic acid, aromatic monobasic acids (e.g., benzoic acid, iodobenzoic acid, salicyclic acid), quinonic acid, tetracyano-p-benzoquinodimethane, or 2,4,7-trinitrofluorenone. Of these, maleic acid, maleic anhydride, phthalic acid, phthalic anhydride and benzoic acid are preferred. These compounds are used either singly or in combination of two or more.

The electron-donating organic compounds that can be used may be any compound which has the property of increasing the conductivity of the photoconductive zinc oxide (C) by donating electrons on the interface between it and the photoconductive zinc oxide (C). Suitable electron-donating organic compounds include, for example, pyrene, anthracene, coronene, 1,2,5,6-dibenzoanthracene, 1,2-benzoanthracene, anthanthrene, ovalene, pyranthrene, tetracene, violanthrene, isoviolanthrene, pentacene, dimethylaniline, p-phenylenediamine, tetramethyl-p-phenylenediamine, durenediamine, 1,5-diaminophthalein, 1,6-diaminopyrene, phenothiazine, tetrathiotetracene, and tetramethylbenzidine. Of these, pyrene, anthracene and phenothiazine are especially preferred. These compounds are used either singly or in combination of two or more.

It is necessary for the organic compound (B) to be adsorbed onto the surface of the photoconductive zinc oxide (C) when dispersed in the blended olefin resin composition (A). Suitable methods for causing the organic compound (B) to be adsorbed to the photoconductive zinc oxide (C) include a wet method which comprises adding the photoconductive zinc oxide (C) to a solution or dispersion of the organic compound (B), separating the photoconductive zinc oxide (C) from the mixed solution or dispersion, and then drying it, and a semi-dry method which comprises mixing the powder of photoconductive zinc oxide (C) with a solution or dispersion of the organic compound (B) in a small amount of liquid in a ball mill, pulverizer, supermixer, or ribbon blender.

In the case of the wet method, the amount of the organic compound (B) to be dissolved or dispersed is preferably $10^{-6}$ to 1 mol/liter-solvent, and finally, the amount dissolved or dispersed in the solution or dispersion is $10^{-3}$ to $10^{-2}$ mol/liter-solvent. When the amount of the organic compound (B) to be dissolved or dispersed is $10^{-6}$ to 1 mol/liter-solvent, the photoconductive zinc oxide (C) adsorbed to the surface of the organic compound (B) has superior photoconductivity, and the light decay characteristics of the resulting electrophotographic recording material become superior. However, when the amount of the organic compound (B) dissolved or dispersed is smaller than $10^{-6}$ mol/liter, the photoconductivity of the zinc oxide powder (C) adsorbed to the surface of the organic compound (B) is reduced, and the light decay characteristics of the electrophotographic material obtained by the present invention tend to be deteriorated. A similar tendency is observed when the amount of the organic compound (B) dissolved or dispersed exceeds 1 mol/liter.

The amount of the organic compound (B) adsorbed to the surface of the photoconductive zinc oxide (C) varies over a wide range according to the type of the organic compound (B) or the photoconductive zinc oxide (C). Generally, the preferred amount is at least $10^{-8}$ mol per gram of the zinc oxide (C). More preferably, the amount is at least $10^{-7}$ mol per gram of the photoconductive zinc oxide (C). When the amount of the organic compound (B) adsorbed is within the above-specified range, the light decay characteristics of the electrophotographic recording material obtained by this invention are improved, and images formed on the recording material have superior clearness and resolving power.

Examples of the saturated or unsaturated fatty acid used for forming the metal salt (D) are caprylic acid, capric acid, citronellic acid, lauric acid, myristic acid, palmitic acid, stearic acid, oleic acid, linolic acid, linoleic acid, arachidic acid, clupanodonic acid, nisinic acid, and zoomaric acid. Suitable saturated or unsaturated fatty acids are those containing 12 to 20 carbon atoms, and those containing 6 to 18 carbon atoms give the best results.

Suitable metals of Groups IIa, IIb or IVb of the periodic table used for preparing the metal salts (D) include, for example, magnesium, calcium, barium, zinc, cadmium, tin, and lead. The use of radium of Group II of the periodic table should be avoided since it is a radioactive element and its radioactivity adversely affects the photographic recording properties of the material.

The amount of the metal salt (D) used in this invention is 0.06 to 0.4 part by weight, preferably 0.07 to 0.35 part by weight, per 100 parts by weight of the total of the components (A), (B) and (C). When the metal salt (D) is used in the aforesaid amounts, the repetitive usability of the electrophotographic recording material in electrophotographic recording becomes superior.

The metal salt (D) makes it possible to decrease an electric charge on the surface of the resulting electrophotographic recording material to a suitable level during electrophotographic recording, to improve the light decay characteristics of the electric potential, and to remove the residual electric charge.

The silicone polymer (E) is incorporated in the recording material of this invention in an amount of 1 to 20 parts by weight, preferably 3 to 10 parts by weight, per 100 parts by weight of the blended olefin resin composition (A). Suitable silicone polymers (E) include dimethylsiloxane-type polymers and methylphenyl siloxane-type polymers. Specific examples include dimethylpolysiloxane and methylphenylpolysiloxane.

The viscosity of the silicone polymer (E) is suitably 100 to 1,000,000 centipoises, preferably 300 to 100,000 centipoises, at 25° C. It has been found that silicone polymers (E) having viscosities within this range serve to stabilize the zinc oxide (C) having adsorbed thereto the light-sensitizing organic compound (B) against the action of humidity and moisture. The viscosities of silicone polymers are measured by ASTM D2515-66.

The silicone polymer (E) serves to maintain the electrophotographic properties of the recording material of this invention over long periods of time, and to prevent these electrophotographic recording properties from being deteriorated by changes in environmental conditions, especially humidity and moisture, during storage or transportation.

If desired, the recording material of this invention may further contain an antioxidant-heat stabilizer, preferably those of the triazine or phenol type, in an amount of 0.0001 to 1 part by weight, preferably 0.001 to 0.1 part by weight, per 100 parts by weight of the blended olefin resin composition (A). Examples of suitable stabilizers include triazine derivatives such as 2,4-bis(n-octylthio)-(4-hydroxy-3,5-di-tertbutylanilino)-1,3,5-triazine, amido-containing hindered phenols such as N,N'-hexamethylene-bis(3,5-di-tert-butyl-4-hydroxyhydrocinnamide), and alkyl phenol derivatives such as 2,2'-methylene-bis(4-methyl-6-tert-butyl)phenol.

The antioxidant-heat stabilizer serves to stably retain the photoconductivity of the zinc oxide (C) having adsorbed thereto the sensitizer (B) even at the time of melt-shaping of the blended olefin resin composition (A).

The recording material can be produced by various conventional fabricating methods such as extrusion molding, injection molding, rolling, compression molding, blow molding, and deep-draw molding, and in the present specification and the appended claims, all of these fabricating methods will be referred to simply as "extrusion". The fabricated material may be in any form such as films, sheets, plates or tubes.

For example, when it is desired to obtain a sheet-like material, the components (A), (B), (C), (D) and (E) are mixed together and kneaded, and melted, and the molten mixture is subjected to calender rolls to form it into a sheet. Alternatively, the mixture can be extruded into a sheet form by an extruder. Other methods can also be used to prepare a sheet-like molded article.

The thickness of the fabricated article is not critical, but generally, the suitable thickness is 5 to 30 microns. Most suitably, the thickness is 10 to 20 microns. In the fabricated article so obtained, the organic compound (B) and the powder of photoconductive zinc oxide (C) are uniformly dispersed or non-transparent paper-like surface. Such a fabricated article becomes a good electrophotographic recording material.

Thus, the recording material of this invention differs from the conventional recording materials in that it is fabricated by "extrusion".

Ionizing radioactive rays or ionizing radiant rays may be applied to the electrophotographic recording material of this invention prior to electrophotographic recording, in order to better the surface potential at the time of charging, the surface potential retention in dark places, and the decay characteristics of the surface potential at the time of exposure, and to obtain recorded images having high density and being free from fog.

Suitable ionizing radioactive rays are, for example, $\alpha$-rays, $\beta$-rays, $\gamma$-rays, accelerated electron beams emitted from an electron beam generator, and X-rays which are electromagnetic waves emitted from an X-ray generator. The $\gamma$-rays, X-rays, and the accelerated electron beams are most suitable.

Suitable ionizing radiant rays are near ultraviolet rays, distant ultraviolet rays, and radiant rays obtained by passing an ionizing radioactive ray through a shield, for example, a shield made of a lead plate.

These rays can be irradiated by any conventional method in vacuum, an atmosphere of an inert gas, or an atmosphere of air. The irradiation dose is preferably $10^2$ to $10^8$ rad., and most preferably $10^3$ to $10^7$ rad., in the case of ionizing radioactive rays. In the case of ionizing radiant rays, the suitable dose is $10^4$ to $10^{10}$ erg/g, and the most suitable dose is $10^5$ to $10^9$ erg/g.

It has been found that the irradiation of the ionizing radioactive rays or ionizing radiant rays results in a marked improvement in the characteristics of the recording material which are required for electrophotographic recording, such as the surface charge generated by corona discharge at the time of copying operation, the retention of surface potentials in dark places, or the decay characteristics of the surface potential during exposure to light.

One or both surfaces of the resulting electrophotographic recording material of this invention can be used for various applications associated with electrophotographic recording. If desired, it can be laminated onto a suitable substrate to form a laminate-type recording material. Suitable substrates used for forming the laminate-type recording material are a metal foil such as an aluminum foil, and a shaped article of a thermoplastic resin containing dispersed therein an electrically conductive substance for controlling the amount of charge.

The laminate-type recording material described above permits a proper control of the amount of charge on the surface of the recording layer consisting of the electrophotographic recording material of this invention at the time of electrophotographic recording. Furthermore, the laminate-type recording material has improved light decay characteristics, and can decrease the residual electric charge on the surface of the record layer.

The thermoplastic resin to be used for forming the charge controlling substrate layer on which to laminate the recording layer may be an olefin resin, a styrene resin, a vinyl resin, or an acrylate resin. These resins are used singly or in admixture of two or more.

Examples of especially suitable thermoplastic resins are a homopolymer of ethylene, copolymers of ethylene with other copolymerizable monomers (e.g., vinyl acetate, vinyl chloride, styrene, propylene, alkyl acrylates, acrylamide, aluminum acrylate, magnesium acrylate), a homopolymer of propylene, copolymers of propylene with other copolymerizable monomers (e.g., vinyl acetate, ethylene, dicyclopentadiene, vinyl alcohol, 1,4-hexadiene), a homopolymer or styrene, a styrene/$\alpha$-methylstyrene copolymer, an acrylonitrile/butadiene/styrene copolymer, and a homopolymer of vinyl chloride.

The electrically conductive substance is one having the property of transporting electric charge by the conduction of electrons or ions, and can be used in the form of powder or liquid.

Examples of the electrically conductive substance are metal powders such as carbon powder, aluminum powder, iron powder, nickel powder, or copper powder; various inorganic salts such as sodium chloride, potassium chloride, or ammonium chloride; metal oxide powders such as iron oxide or manganese oxide; nonionic polymeric electrolytes such as polyvinyl alcohol, polyethylene oxide, polyacrylamide, or polyvinyl pyrrolidine; anionic polymeric electrolytes such as polyacrylic acid, polyvinyl sulfonate, inorganic polyphosphonate, or organic polyphosphonate esters; cationic polymeric electrolytes such as polyethyleneimine, poly-N-methyl-4-vinyl pyridinium chloride, poly-2-methacryloxyethyl trimethyl ammonium chloride, or polyglycidyl tributyl phosphonium chloride; and ionic electrically conductive substances such as electrically conductive oligomers.

The amount of the electrically conductive substance is usually 0.1 to 50 parts by weight, most suitably 1 to 30 parts by weight, per 100 parts by weight of the thermoplastic resin used for producing the charge control substrate layer. If the amount exceeds 50 parts by weight, the amount of charge on the surface of the recording layer tends to decrease during electrophotographic recording, and the decay of the potential by light is not sufficient, which in turn may cause the resulting recorded image to lose its clearness. If the amount is less than 0.1 part by weight, the amount of charge on the surface of the recording material becomes excessive during electrophotographic recording, and the light decay of the potential is insufficient. This results in residual charges and consequently the formation of fog on the recorded images.

The formation of the charge control substrate layer from the thermoplastic resin and the electrically conductive substance can be accomplished by the various fabricating methods used to form the recording layer.

The form of the charge control substrate layer can be changed according to the recording layer, and may be a film, sheet, plate, rod, tube, or any other desired shape.

The lamination of the charge control substrate layer and the recording layer can be performed by any desired method, such as a method using an adhesive, a method involving heat bonding, a method comprising forming one of the two layers in advance, and laminating it as the other layer is being prepared, or a method involving forming both layers simultaneously in a unitary structure.

The thickness of the recording layer is 5 to 30 microns, preferably 10 to 20 microns. The thickness of the charge control substrate layer consisting of the thermoplastic resin and the electrically conductive substance is suitably 30 to 1000 microns, more suitably 50 to 100 microns.

The electrophotographic recording materials comprising the blended olefin resin composition (A) and uniformly dispersed therein, the light-sensitizing organic compound (B), the particulate photoconductive zinc oxide (C), the metal salt (D), and the silicone polymer (E) are used for recording in various applications such as electrophotography, rapid phototransmission, and high-speed communication. In this electrophotographic recording material, the organic sinsitizer compound (B) has the property of widening the spectral absorption region of the particulate zinc oxide (C) at the interface between it and the zinc oxide (C), and has the advantage of increasing the conductivity of the zinc oxide (C) and producing clear images.

The electrophotographic recording material of this invention has the advantage that because of the presence of the metal salt (D), the amount of charge on the surface of the recording material can be reduced to a level suitable for electrophotographic recording and the light decay of the potential is improved to prevent residual charge, whereby a clear recorded image free from fog can be obtained.

Furthermore, by the use of the silicone polymer (E), the electrophotographic recording properties of the electrophotographic recording material can be retained over long periods of time, and the electrophotographic properties are not deteriorated by changes in environmental conditions, such as moisture and humidity.

By subjecting the electrophotographic recording material of this invention to the irradiation of ionizing radioactive rays or ionizing radiant rays prior to electrophotographic recording, the surface potential of the material during electrophotographic recording can be maintained high and this high potential can be retained even in dark places. Thus, the decay of the surface potential on exposure to light is excellent, and a recorded image having high density and being free from fog can be obtained.

Moreover, the electrophotographic recording material of this invention consisting of a laminate of the above electrophotographic recording material and a layer for controlling the amount of charge has the advantage that the amount of charge on the surface of the recording layer can be reduced to a level suitable for electrophotographic recording, and the decay of the potential by light is bettered to prevent the residual electric charge. This leads to a very clear recorded image free from fog.

The electrophotographic recording materials of this invention described above can be used widely for recording by various electrophotographic methods as an electrophotographic copying paper, a master sheet, an electrophotographic recording drum, etc.

The following Examples further illustrate the present invention. In these Examples, all parts are by weight.

EXAMPLE 1

(A) Sensitizing treatment:

Rose Bengal (101 g) was dissolved in 900 ml of methanol in a 2-liter flask. The entire solution of Rose Bengal and 33.5 kg of white unsensitized zinc oxide powder were placed in a 100-liter supermixer and stirred at room temperature for 10 minutes. The mixture was then dried by hot air at 50° C. for 24 hours to afford zinc oxide powder having Rose Bengal adsorbed to its surface.

In this sensitizing treatment, deposition of the solution of Rose Bengal on the zinc oxide powder was performed in a nearly dry condition because the volume of the Rose Bengal solution was extremely small in comparison with the volume of the zinc oxide powder.

(B) Film formation:

A 100-liter supermixer was charged with 33.5 kg of the resulting zinc oxide powder having Rose Bengal adsorbed to its surface, 78 g of zinc stearate, and 6.7 kg of a blended olefin resin composition consisting of 1 kg of high density polyethylene having a melt index of 0.15 g/10 minutes, 3 kg of low density polyethylene having a melt index of 2.0 g/10 minutes, and 2.7 kg of an ethylene/vinyl acetate copolymer having a melt index of 200 g/10 minutes to mix them with one another. The proportion of zinc stearate in this mixture was 0.21% by weight. The resulting mixture was kneaded together with 200 g of methylphenyl polysiloxane having a viscosity at 25° C. of 450 centipoises and 1.5 g of a triazine-type antioxidant-heat stabilizer at 140° C. for 20 minutes by kneading rolls, and formed into a sheet-like article. The sheet-like article was formed into pellets by a pelletizer.

The pellets were charged into a monoaxial screw with a screw diameter of 65 mm, and extruded at a resin temperature of 150° C. from a 600-mm wide coat hanger die mounted at the end of the extruder to form a film having a thickness of 20 microns.

(C) Evaluation of the electrophotographic recording characteristics:

The electrophotographic recording characteristics of the film were evaluated by the following procedures.

(1) Items measured:

Electrophotographic recording characteristics in initial and repeated recordings.

(2) Measuring instrument:

Electrostatic Paper Analyzer SP428 (a product of Kawaguchi Denki Seisakusho).

(3) Method of measurement:

The electrophotographic recording characteristics were measured by the following procedures. All the measurements followed by the Dynamic method at a turntable speed of 1,000 rpm.

(a) Conditions for the first measurement:

Chargeability measuring conditions:

Corona discharge voltage: -6 KV

Corona discharge time: 10 seconds

Dark decay measuring conditions:

The sample was left to stand for 10 seconds in the dark immediately after stopping corona discharge.

Sensitivity measuring conditions:

Light source: Tungsten lamp (color temperature 2854° K)

Total amount of exposure: 43 lux.sec. (illumination 10 lux; exposure time 30 seconds; exposure probability 1/7)

(b) Intensive irradiation conditions:

Immediately after the first measurement described in (a) above, intensive irradiation was performed under the following conditions.

Light source: tungsten lamp (color temperature 2854° K)

Illumination: 160,000 lux

Total amount of exposure: 91,400 lux.sec. (illumination 160,000 lux, exposure time 4 seconds; exposure probability 1/7)

(c) Conditions for the second measurement (repetition of recording):

Immediately after the intensive irradiation, the electrophotographic recording characteristics were measured under the same conditions as the conditions for the first measurement.

(d) The diagram in FIG. 1 shows the relation between the characteristic values and the pattern of the characteristic curve.

In FIG. 1, $V_S^N$ (N=1,2) is the saturated potential (V) measured in the Nth cycle of repeated electrophotographic recording;

$V_O^N$ (N=1,2) is the initial potential (V) immediately after the dark decaying of $V_S^N$ for 10 seconds;

$T_{\frac{1}{2}}^N$ (N=1,2) is the time required for reaching $V_S^N/2$ (half-height value of $V_S^N$), which corresponds to the charge rising speed;

$E_{\frac{1}{2}}^N$ (N=1,2) is the amount of exposure (lux.sec.) required for reducing $V_O^N$ to half, which corresponds to sensitivity;

$100 \times V_S^N/V_S^1$ is the percentage of the saturated potential after repeating electrophotographic recording through N cycles;

$100 \times V_O^N V_{O1}$ is the percentage of the initial potential after repeating electrophotographic recording through N cycles;

$100 \times T_{\frac{1}{2}}^N/N_{\frac{1}{2}}^1$ is the percentage of the charge rising speed after repeating electrophotographic recording through N cycles, and $100 \times E_{178}^N/E_{\frac{1}{2}}^1$ is the percentage of the sensitivity after repeating electrophotographic recording through N cycles.

(4) Results of measurement:

The characteristic values measured are given in Table 1 below.

Table 1

| N | 1 | 2 |
|---|---|---|
| $V^N_S$ (volts) | 760 | 770 |
| $V^N_O$ (volts) | 580 | 560 |
| $T^N_{\frac{1}{2}}$ (seconds) | 0.4 | 1.2 |
| $E^N_{\frac{1}{2}}$ (lux.sec.) | 5.7 | 6.4 |

EXAMPLE 2

A film was prepared in the same way as in Example 1 except that the amount of zinc stearate used in Example 1 was changed respectively to (i) 22 g (0.06% by weight in the entire mixture), (ii) 37 g (0.1% by weight), (iii) 74 g (0.2% by weight), and (iv) 148 g (0.4% by weight).

The electrophotographic recording characteristics of the film were measured in the same way as in Example 1, and the results are given in Table 2.

Table 2

| Zinc stearate (amount) | 22 g (i) | | 37 g (ii) | | 74 g (iii) | | 148 g (iv) | |
|---|---|---|---|---|---|---|---|---|
| N | 1 | 2 | 1 | 2 | 1 | 2 | 1 | 2 |
| $V^N_S$ (volts) | 800 | 800 | 850 | 850 | 830 | 830 | 820 | 820 |
| $V^{N0}_S$ (volts) | 700 | 650 | 810 | 780 | 810 | 760 | 800 | 720 |
| $T^{N0}_1$ (seconds) | 0.3 | 1.2 | 0.4 | 1.2 | 0.6 | 1.4 | 0.5 | 1.4 |
| $E^{N1}_{\frac{1}{2}}$ (lux.sec.) | 5.4 | 5.9 | 4.6 | 5.1 | 7.5 | 7.9 | 10.5 | 11.0 |
| $100 \times V^N_S/V^1_S$ (%) | — | 100 | — | 100 | — | 100 | — | 100 |
| $100 \times V^{N0}_S/V^{1}_{S0}$ (%) | — | 93 | — | 96 | — | 94 | — | 90 |
| $100 \times T^{N0}_1/T^1_1$ (%) | — | 400 | — | 360 | — | 230 | — | 280 |
| $100 \times E^{N1}_{\frac{1}{2}}/E^{1}_{\frac{1}{2}}$ (%) | — | 109 | — | 110 | — | 105 | — | 105 |

COMPARATIVE EXAMPLE 1

A film was prepared in the same way as in Example 1 except that the amount of zinc stearate used in Example 1 was changed respectively to (i) 0.38 kg (1.0% by weight in the total mixture), (ii) 1.41 kg (3.7% by weight), and (iii) 1.94 kg (5.0% by weight). The electrophotographic recording characteristics of the film were measured in the same way as in Example 1, and the results are shown in Table 3.

Figure 2:
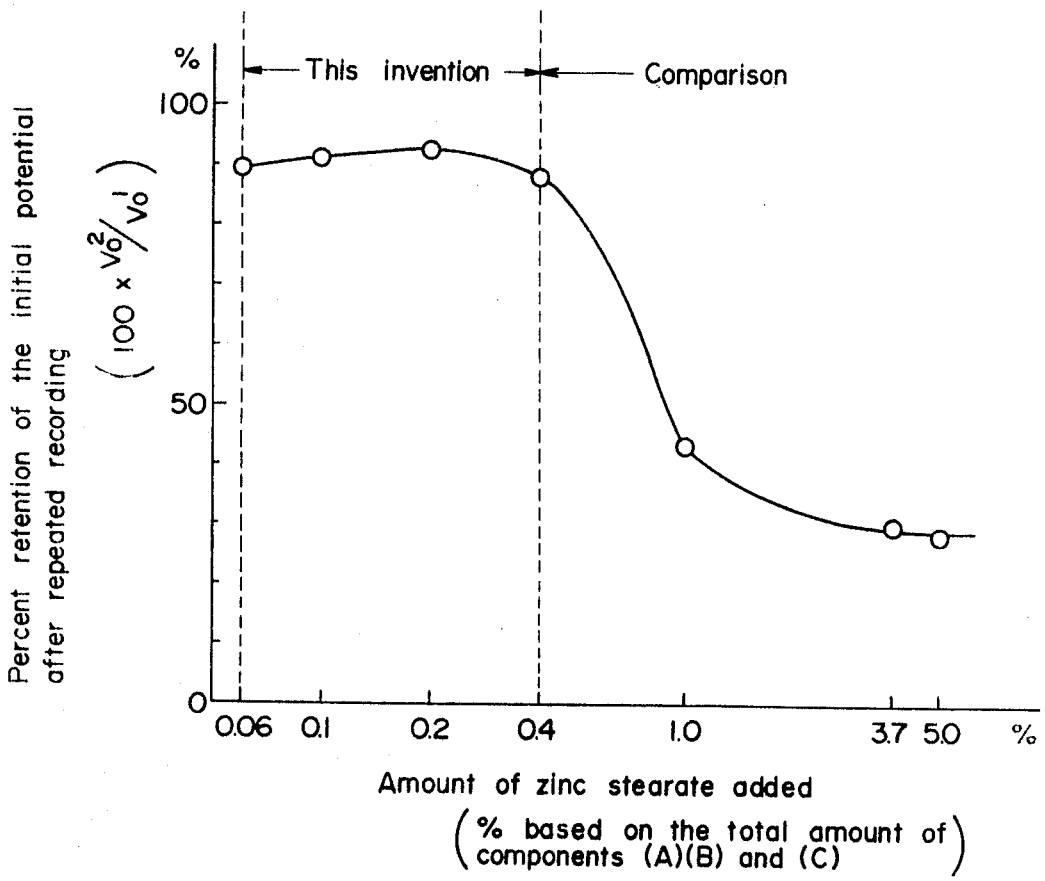

The dependence of the percent retention of the initial potential after repeated recording upon the amount of zinc stearate is plotted in FIG. 2 on the basis of the results obtained in Example 2 and Comparative Example 1.

Table 3

| Zinc stearate (amount) | 0.38 kg (i) | | 1.41 kg (ii) | | 1.94 kg (iii) | |
|---|---|---|---|---|---|---|
| N | 1 | 2 | 1 | 2 | 1 | 2 |
| $V^N_S$ (volt) | 750 | 400 | 730 | 360 | 720 | 240 |
| $V^{N0}_S$ (volt) | 680 | 270 | 650 | 200 | 660 | 180 |
| $T^{N0}_1$ (seconds) | 0.5 | 4.5 | 0.6 | 4.9 | 0.5 | 5.1 |
| $E^{N1}_{\frac{1}{2}}$ (lux.sec.) | 12.0 | 20.0 | 13.5 | 19.7 | 14.3 | 35.6 |
| $100 \times V^N_S/V^1_S$ (%) | — | 53 | — | 49 | — | 33 |
| $100 \times V^{N0}_S/V^{1}_{S0}$ (%) | — | 39 | — | 31 | — | 27 |
| $100 \times T^{N0}_1/T^1_1$ (%) | — | 900 | — | 817 | — | 1020 |
| $100 \times E^{N1}_{\frac{1}{2}}/E^{1}_{\frac{1}{2}}$ (%) | — | 167 | — | 145 | — | 249 |

EXAMPLE 3

10 Parts of a solution (prepared from 5 parts of Rose Bengal, 5 parts of phthalic anhydride and 100 parts of ethanol) was mixed with 700 parts of a powder of zinc oxide in a supermixer for 5 minutes at room temperature to cause the Rose Bengal and phthalic anhydride to be adsorbed to the surface of the zinc oxide powder. 83 Parts of the zinc oxide powder having the Rose Bengal and phthalic anhydride adsorbed to its surface, 30 parts of a powder of a blended olefin resin composition (consisting of 2.5 parts of high density polyethylene having a melt index of 0.15 g/10 minutes, 5.0 parts of low density polyethylene having a melt index of 80 g/10 minutes, 6.5 parts of polypropylene having a melt index of 7.0 g/10 minutes, and 2.5 parts of polybutene having a melt index of 300 g/10 minutes), 0.3 part of zinc stearate, 0.5 part of dimethyl polysiloxane having a viscosity of 10,000 centipoises at 25° C., and 0.005 part of an alkylphenol-type antioxidant-heat stabilizer were placed in a supermixer and mixed at room temperature for 5 minutes. The mixture was granulated by a pelletizer, and formed into a sheet-like article by an extruder.

On the other hand, 100 parts of a powder of high density polyethylene and 25 parts of a powder of carbon were mixed at room temperature for 5 minutes in a supermixer to disperse these materials uniformly. The mixture was kneaded on a kneading roll at 160° C. for 15 minutes, and then formed into a sheet-like article using a hot press at 150° C.

The two sheet-like articles obtained above were superimposed, and bonded by a heat press at 150° C. to form a laminate sheet having a thickness of 1.5 mm.

The laminate sheet was maintained at 132° C., and stretched biaxially at the same time in the longitudinal and transverse directions to 4 times the original dimension in each direction.

The resulting electrophotographic recording material was a laminate consisting of a 20 micron thick sheet-like article as a recording layer consisting of the zinc oxide powder having the Rose Bengal and phthalic anhydride adsorbed thereto, zinc stearate, dimethyl polysiloxane, antioxidant heat stabilizer and polyethylene, and a 80 micron thick sheet-like article consisting of the high density polyethylene and carbon powder.

The recording material had superior bending strength, tear strength, and other mechanical strength characteristics.

The recording material was subjected to a copying test using an electrophotographic copying machine. It was found that the images obtained had superior clearness and resolving power and superior sensitivity to red, blue and black colors, and were free from fog.

The electrophotographic recording material was further subjected to an electrostatic copying paper test on an electrostatic copying paper tester (product of Kawaguchi Electric Works, Ltd.), and it was found that the material exhibited superior light decay characteristics and permitted no residual potential. No deterioration in electrophotographic recording properties by the effect of moisture and humidity occurred either.

EXAMPLE 4

Rose Bengal (100 g) and 9.0 g of phthalic anhydride were dissolved in 500 ml of ethanol, and 30 kg of a powder of zinc oxide was added to the resulting solution. The mixture was stirred for 45 minutes at room temperature using a mixing stirrer. Then, the resulting mixture was further mixed with 66 kg of a blended olefin resin composition (consisting of 0.8 kg of high density polyethylene having a melt index of 0.15 g/10 minutes, 2.9 kg of low density polyethylene having a melt index of 2.0 g/10 minutes, and 2.9 kg of an ethylene/vinyl acetate copolymer having a melt index of 300 g/10 minutes), 100 g of zinc stearate, 330 g of dimethyl polysiloxane having a viscosity at 21° C. of 300 centipoises, and 1.2 g of a triazine-type antioxidant heat stabilizer, and dried in air at 70° C. for 1 hour. The mixture obtained was kneaded for 15 minutes at 160° C. using a roll kneader, and then granulated by an extrusion molding machine. The granular product was put into an extrusion molding machine having a film-forming die fitted to its tip, and extruded at 210° C. at a rate of 30 kg/hour to form a film having a thickness of 80 microns.

The resulting film was subjected to the irradiation of $\gamma$-rays generated from Co-60 (3000 Curie) in an atmosphere of air at room temperature in a total dose of 1 Mrad at a dose rate of $1 \times 10^5$ rad./hr.

Electrophotographic recording was performed on the resulting irradiated film by a wet-type electrophotographic copying apparatus. Clear recorded images having a high image density and being free from fog by the toner could be obtained. Furthermore, the recorded images had superior sensitivity to blue, red, and black colors.

Furthermore, the irradiated film was tested for electrophotographic characteristics using an electrostatic copying paper tester (product of Kawaguchi Electric Works, Ltd.; Model SP-428). The results are shown in Table 4. It is seen from the results shown in Table 4 that the resulting film had superior surface charging property by corona discharge, superior retention of surface potential in dark places, and superior decay of surface potential upon exposure to light.

For comparison, the same 80 micron thick film was prepared by extrusion through a film-forming die in the same way as described above except that it was not subjected to the irradiation of ionizing radioactive rays. The film was tested for electrophotographic properties using the same electrostatic copying paper tester described above. The results are also shown in Table 4. Table 4 shows that the tested properties of the comparison film were inferior to those of the film subjected to the irradiation of ionizing radioactive rays.

Table 4

| | Example 4 | Comparison |
|---|---|---|
| $v_5$ | −1300 | −650 |
| $v_{10}$ | −1300 | −590 |
| $(v_{10}-v_{12})/v_{10}$ | 98 | 75 |
| $\tau_{\frac{1}{2}}$ | 0.6 | 1.4 |
| $E_{10}$ | 40 | 95 |

The items $v_5$, $v_{10}$, $(v_{10}-v_{12})/v_{10}$, ($\frac{1}{2}$ and $E_{10}$ shown in Table 4 represent the following.

$v_5$: Surface potential (volts) measured 5 seconds after the initiation of corona discharge at −6Kv.

$v_{10}$: Surface potential (volts) measured after standing for 5 seconds in a dark place following the stopping of discharge.

$(v_{10}-v_{12})/v_{10}$:

Light decay rate (%) measured after 2 seconds from the initiation of intermittent exposure to 200 lux tungsten-filament lamp at 17 cycles/sec.

$\tau\ \frac{1}{2}$: Half life (seconds) of the surface potential under the above exposure conditions.

$E_{10}$: Amount of exposure (lux.sec.) required to reduce the residual surface potential to 10% of $v_{10}$ after initiation of exposure under the above exposing conditions.

EXAMPLE 5

An 80 micron thick film extruded from a film-forming die of an extrusion molding machine in the same way as in Example 4 was subjected to the irradiation of electron beams in an atmosphere of air at room temperature in a total dose of 2 Mrad using a 2 meV electron beam accelerator.

Electrophotographic recording was performed on the resulting film using an electrophotographic copying machine. Recorded images having a high image density and being free from fog by the toner could be obtained.

EXAMPLE 6

An 80 micron-thick film extruded from a film-forming die of an extrusion molding machine in the same way as in Example 4 was subjected to the irradiation of ionizing radiant rays in a total dose of 10 erg/g in an atmosphere of air at room temperature. The radiant rays were obtained by impinging electron beams generated by a 2 meV electron beam accelerator against a lead plate having a thickness of 1.5 mm.

Electrophotographic recording was performed on the resulting irradiated film using an electrophotographic copying apparatus. Recorded images having a high image density and being free from fog by the toner could be obtained.

The irradiated film was tested for electrophotographic properties using the same electrostatic copying paper tester as used in Example 4. The film exhibited substantially the same surface charging property, retention of surface potential in a dark place and decay of surface potential upon exposure to light.

What we claim is:

1. An electrophotographic recording material formed by extrusion, which comprises (A) a blended olefin resin composition consisting essentially of (a) an olefin resin having a melt index of 0.1 to 20 g/10 minutes, and (b) an olefin resin having a melt index of 30 to 300 g/10 minutes, the weight ratio of olefin resin (a) to olefin resin (b) ranging from 5:95 to 95:5, (B) 0.025 to 40 parts by weight, per 100 parts by weight of the blended olefin resin composition (A), of at least one light-sensitizing organic compound selected from the group consisting of organic dye compounds, electron accepting organic compounds and electron-donating organic compounds, (C) 200 to 600 parts by weight, per 100 parts by weight of the blended olefin resin composition (A), of particulate photoconductive zinc oxide having an average particle diameter of 0.1 to 5 microns, (D) 0.06 to 0.4 part by weight, per 100 parts by weight of the total of the components (A), (B) and (C), of a salt formed between a saturated or unsaturated fatty acid containing 12 to 20 carbon atoms and a metal of Group IIa, IIb or IVb (except radium) of the periodic table, and (E) 1 to 20 parts by weight, per 100 parts by weight of the blended olefin resin composition (A), of a silicone polymer, the components (B), (C), (D) and (E) being uniformly dispersed in the component (A), and the light-sensitizing organic compound (B) being adsorbed onto the surface of the particulate photoconductive zinc oxide (C).

2. The electrophotographic recording material of claim 1 which further contains 0.0001 to 1 part by weight, per 100 parts by weight of the blended olefin resin composition (A), of an antioxidant-heat stabilizer.

3. The electrophotographic recording material of claim 2 wherein the anitoxidant-heat stabilizer is selected from triazine type and phenol type antioxidant-heat stabilizers.

4. The electrophotographic recording material of claim 1 wherein the silicone polymer (E) has a viscosity at 25° C. of 100 to 1,000,000.

5. The electrophotographic recording material of claim 1 wherein the light-sensitizing organic compound (B) is adsorbed to the photoconductive zinc oxide (C) in an amount of at least $10^{-8}$ mol per gram of the zinc oxide (C).

6. The electrophotographic recording material of claim 1 which is irradiated with ionizing radioactive rays or ionizing radiant rays.

7. The electrophotographic recording material of claim 6 wherein the dose of irradiation of the ionizing radioactive rays is $10^2$ to $10^8$ rads.

8. The electrophotographic recording material of claim 6 wherein the dose of the irradiation of the ionizing radiant rays is $10^4$ to $10^{10}$ erg/g.

9. The electrophotographic recording material of claim 1 which has a substrate layer composed of a metal.

10. The electrophotographic recording material of claim 1 which has a substrate layer composed of a thermoplastic material containing an electrically conducting substance.

* * * * *